US011081841B2

(12) United States Patent
Hsiao et al.

(10) Patent No.: US 11,081,841 B2
(45) Date of Patent: Aug. 3, 2021

(54) ELECTRICAL CONNECTOR HAIVING CONTACT WAFER EQUIPPED WITH TRANSVERSE GROUNDING BAR

(71) Applicants: FU DING PRECISION INDUSTRIAL (ZHENGZHOU) CO., LTD., Zhengzhou (CN); FOXCONN INTERCONNECT TECHNOLOGY LIMITED, Grand Cayman (KY)

(72) Inventors: Shih-Wei Hsiao, New Taipei (TW); Yu-San Hsiao, New Taipei (TW); Yen-Chih Chang, New Taipei (TW); Wei-Chou Lin, New Taipei (TW); Yu-Ke Chen, Kunshan (CN); Meng Liu, Kunshan (CN); Na Yang, Kunshan (CN); Xiao-Li Liu, Kunshan (CN)

(73) Assignees: FU DING PRECISION INDUSTRIAL (ZHENGZHOU) CO., LTD., Zhengzhou (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/896,156

(22) Filed: Jun. 8, 2020

(65) Prior Publication Data

US 2020/0388967 A1 Dec. 10, 2020

(30) Foreign Application Priority Data

Jun. 6, 2019 (CN) ..... 201910489180.7
Jun. 6, 2019 (CN) ..... 201910489277.8

(51) Int. Cl.
*H01R 13/648* (2006.01)
*H01R 13/6471* (2011.01)
(Continued)

(52) U.S. Cl.
CPC ..... *H01R 13/6471* (2013.01); *H01R 12/727* (2013.01); *H01R 12/732* (2013.01); *H01R 13/502* (2013.01); *H01R 13/6587* (2013.01)

(58) Field of Classification Search
CPC .. H01R 12/727; H01R 12/732; H01R 13/502; H01R 13/6471; H01R 13/6587
(Continued)

(56) References Cited

U.S. PATENT DOCUMENTS 6,293,827 B1 9/2001 Teradyne
9,093,800 B2 7/2015 Te
(Continued)

FOREIGN PATENT DOCUMENTS

CN 1398446 2/2003
CN 1539183 10/2004
(Continued)

*Primary Examiner* — Khiem M Nguyen
(74) *Attorney, Agent, or Firm* — Ming Chieh Chang; Wei Te Chung

(57) ABSTRACT

An electrical connector includes an insulative housing defining a space. A connection module is received within the space. The connection module includes a pair of contact modules commonly sandwiching a grounding module therebetween in the transverse direction. Each contact module includes a plurality of contacts integrally formed within the corresponding insulative wafer via insert-molding. The grounding module includes a grounding plate embedded within an insulative wafer. The grounding plate forms a plurality of fingers respectively electrically and mechanically connecting to the corresponding grounding contacts of the contact modules. The wafer forms a plurality of transverse grooves to receive corresponding grounding bars each having a plurality of inward parts respectively mechanically and electrically connecting to the grounding plate, and a plurality of outward parts respectively mechanically and
(Continued)

electrically connecting to the grounding contacts of the contact modules.

20 Claims, 19 Drawing Sheets

(51) Int. Cl.
*H01R 13/6587* (2011.01)
*H01R 12/72* (2011.01)
*H01R 13/502* (2006.01)
*H01R 12/73* (2011.01)

(58) Field of Classification Search
USPC ..... 439/79, 607.07
See application file for complete search history.

(56) References Cited

U.S. PATENT DOCUMENTS 9,537,239 B1 1/2017 Amphenol
9,640,915 B2 5/2017 Te
10,135,197 B2 * 11/2018 Little ..... H01R 13/6585
10,283,910 B1 * 5/2019 Chen ..... H01R 4/04
10,601,160 B2 * 3/2020 Kao ..... G06F 13/409
2004/0043661 A1 3/2004 Fujitsu
2013/0149881 A1 6/2013 Johnescu
2015/0126066 A1 5/2015 Hai

FOREIGN PATENT DOCUMENTS

CN 1650478 8/2005
CN 201008051 1/2008
CN 102356520 A 2/2012
CN 102801053 11/2012
CN 204304028 4/2015
CN 104737374 6/2015
CN 106207569 12/2016
CN 208738463 4/2019
CN 110994230 A 4/2020
EP 0560550 3/1994
EP 2194606 6/2010

* cited by examiner

ELECTRICAL CONNECTOR HAIVING CONTACT WAFER EQUIPPED WITH TRANSVERSE GROUNDING BAR

BACKGROUND OF THE INVENTION

1. Field of the Invention

The present invention relates generally to an electrical connector, and particularly to the electrical connector with the grounding structure to reduce the resonance effect.

2. Description of Related Arts

U.S. Pat. No. 9,537,239 discloses the orthogonal type connector composed of the contact wafers. Because the length of the contacts are relatively long, it is easy to result in the resonance effect disadvantageously. U.S. Pat. No. 10,461,475 discloses a double deck connector composed of the contact wafers with the transverse grounding bars to reduce the resonance effect.

It is desired to have the orthogonal type connector composed of the contact wafers equipped with the transverse grounding bars to reduce the resonance effect.

SUMMARY OF THE INVENTION

To achieve the above object, an electrical connector includes an insulative housing defining a space. A connection module is received within the space. The connection module includes a pair of contact modules commonly sandwiching a grounding module therebetween in the transverse direction. Each contact module includes a plurality of contacts integrally formed within the corresponding insulative wafer via insert-molding. The grounding module includes a grounding plate embedded within an insulative wafer. The grounding plate forms a plurality of fingers respectively electrically and mechanically connecting to the corresponding grounding contacts of the contact modules. The wafer forms a plurality of transverse grooves to receive corresponding grounding bars each having a plurality of inward parts respectively mechanically and electrically connecting to the grounding plate, and a plurality of outward parts respectively mechanically and electrically connecting to the grounding contacts of the contact modules.

Other advantages and novel features of the invention will become more apparent from the following detailed description of the present embodiment when taken in conjunction with the accompanying drawings.

DETAILED DESCRIPTION OF THE PREFERRED EMBODIMENT

Figure 1:
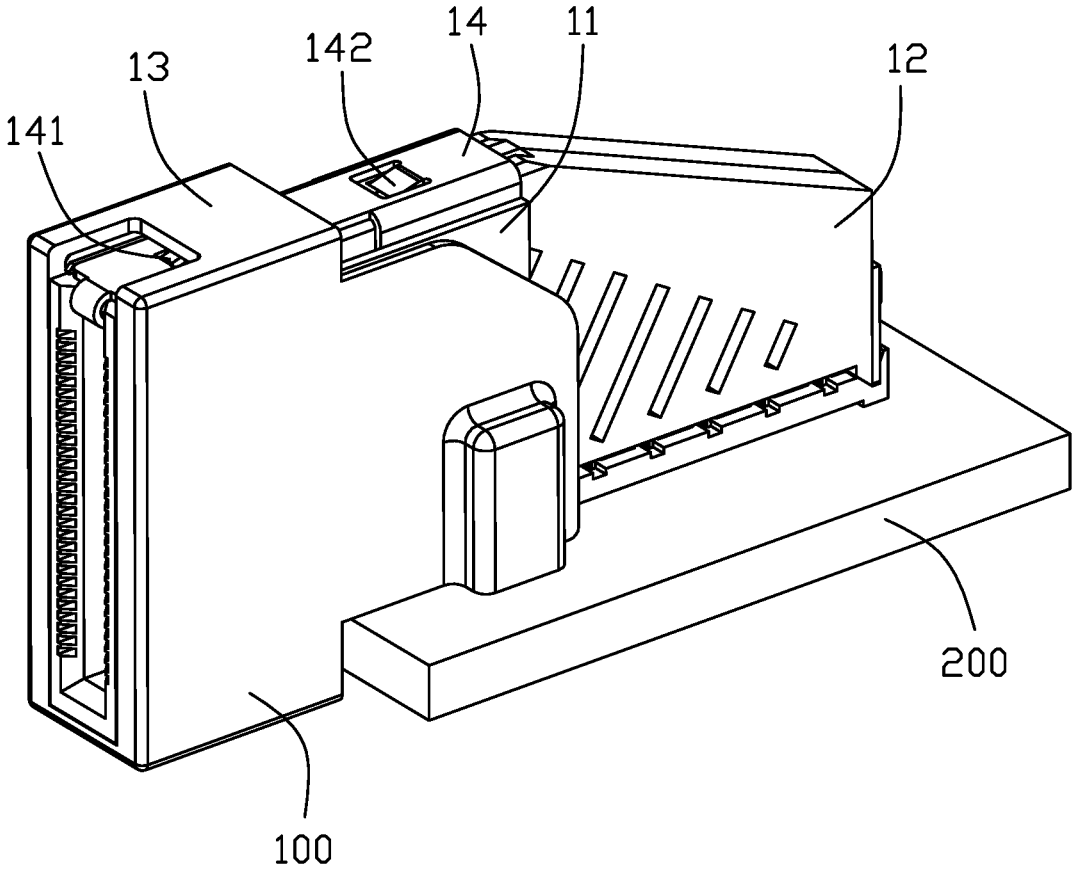
FIG. 1 is a perspective view of the electrical connector mounted upon the printed circuit board according to the present invention.
Figure 2:
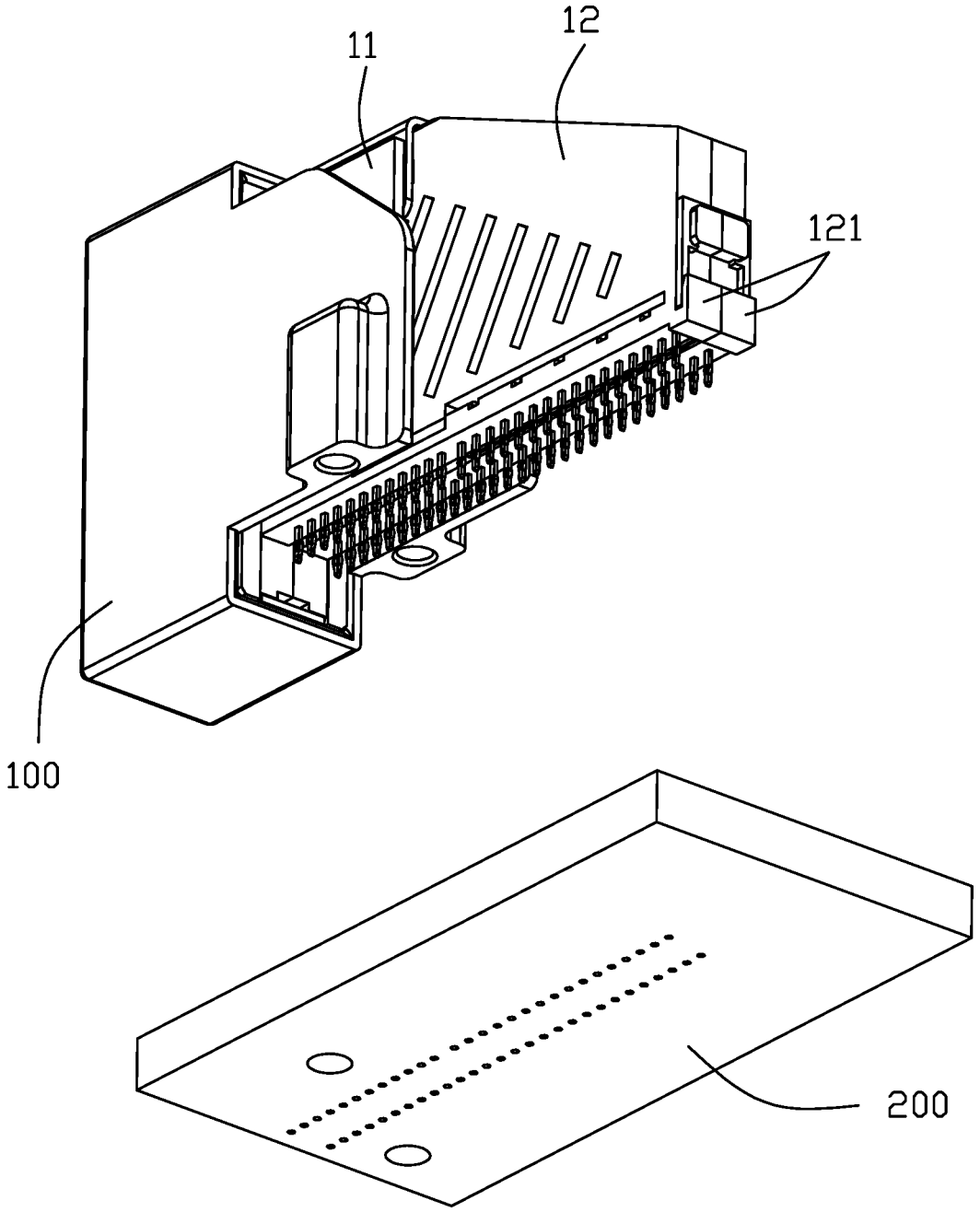
FIG. 2 is an exploded perspective view of the electrical connector of FIG. 1.
Figure 3:
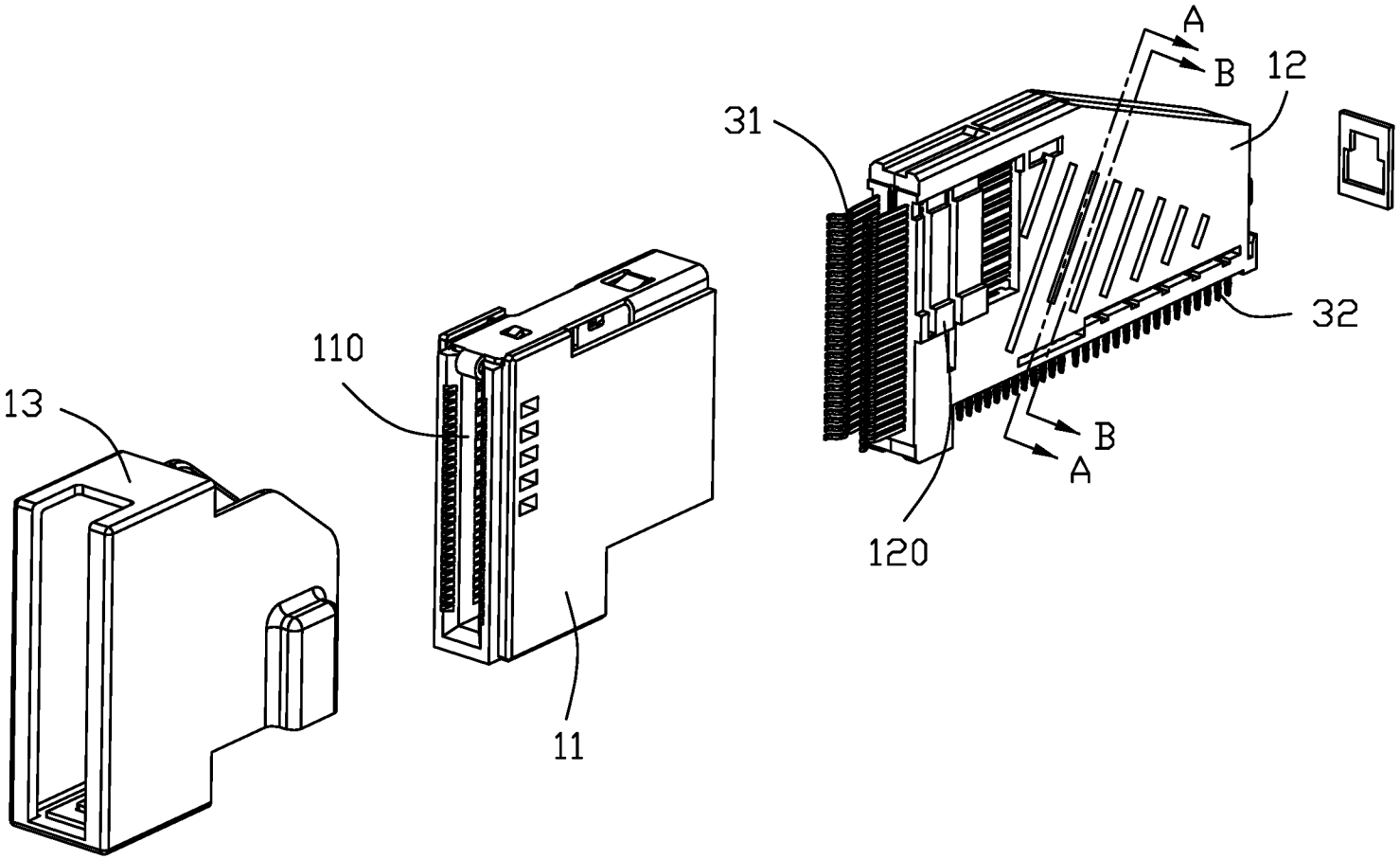
FIG. 3 is a further exploded perspective view of the electrical connector of FIG. 2.
Figure 4:
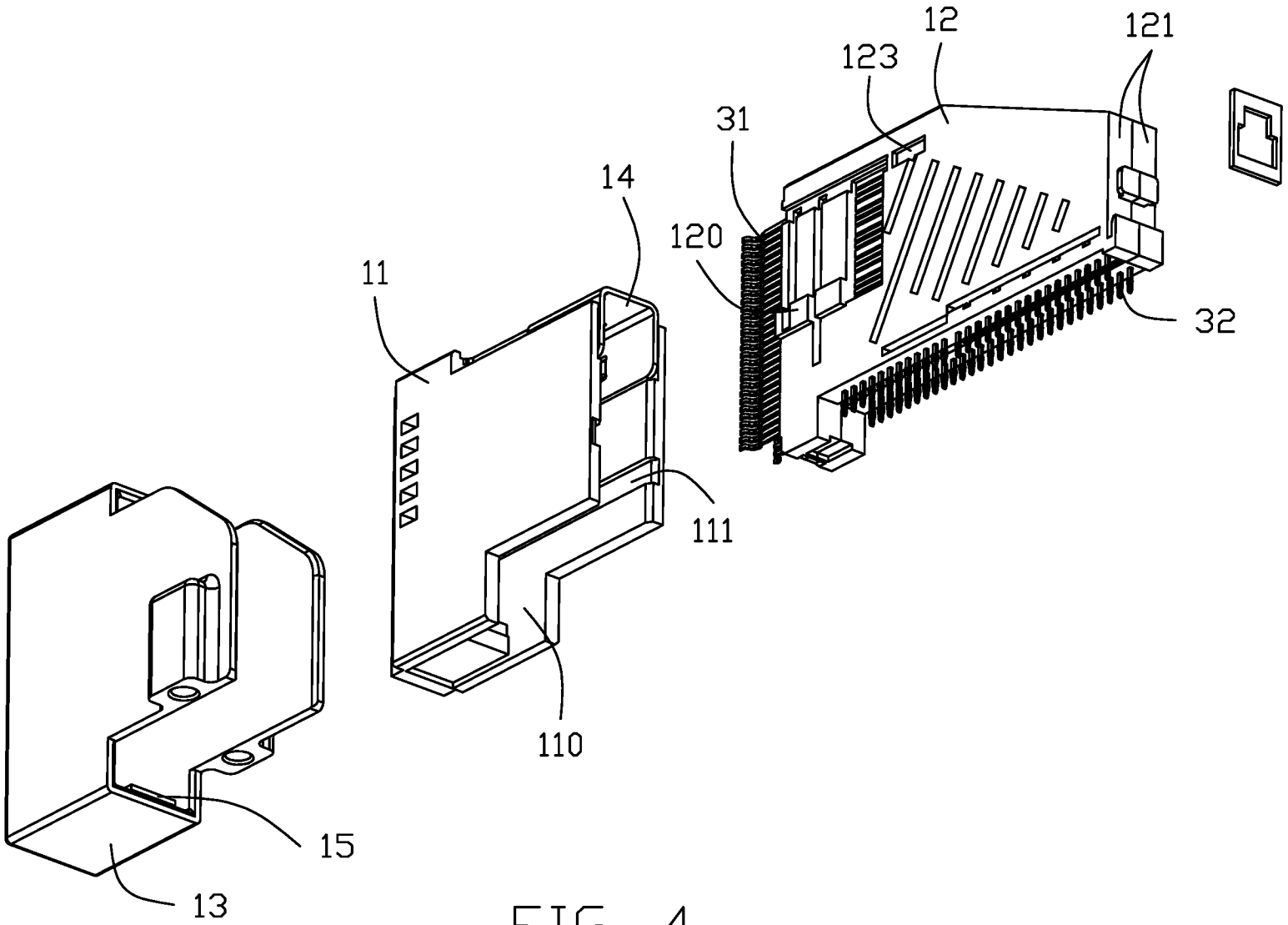
FIG. 4 is another exploded perspective view of the connector of FIG. 3.
Figure 5:
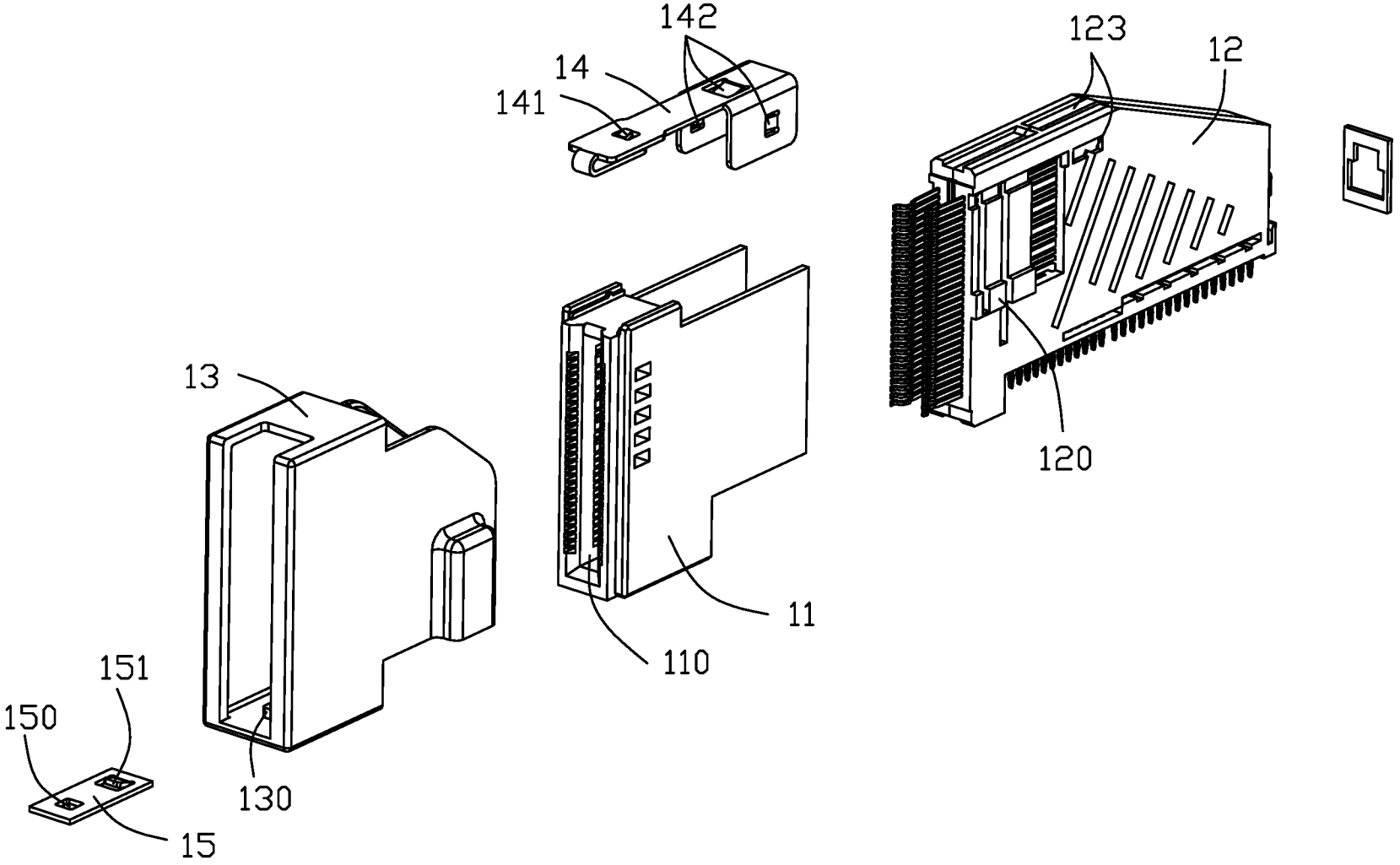
FIG. 5 is a further exploded view of the electrical connector of FIG. 3.
Figure 6:
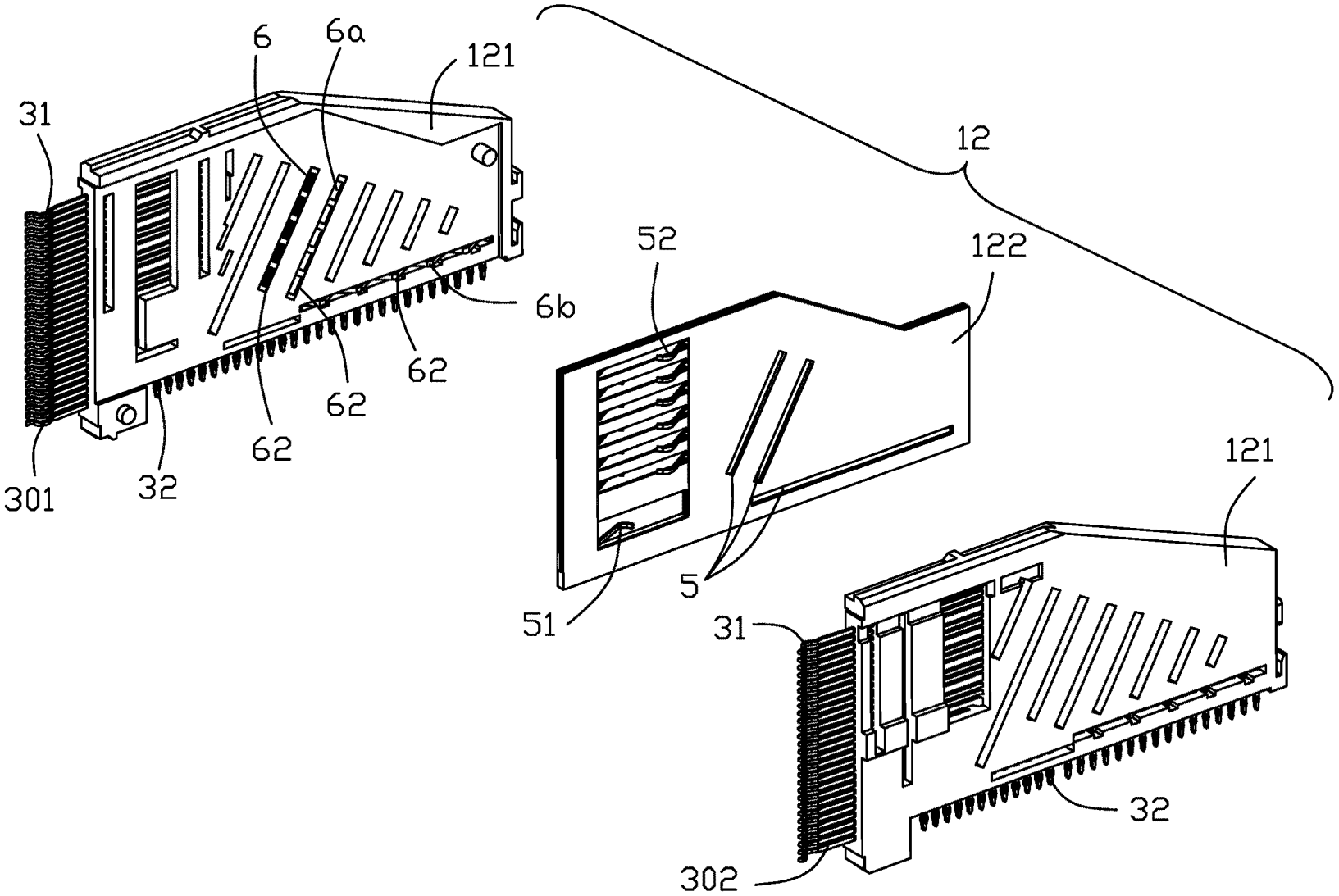
FIG. 6 is an exploded perspective view of the connection module of the electrical connector of FIG. 3.
Figure 7:
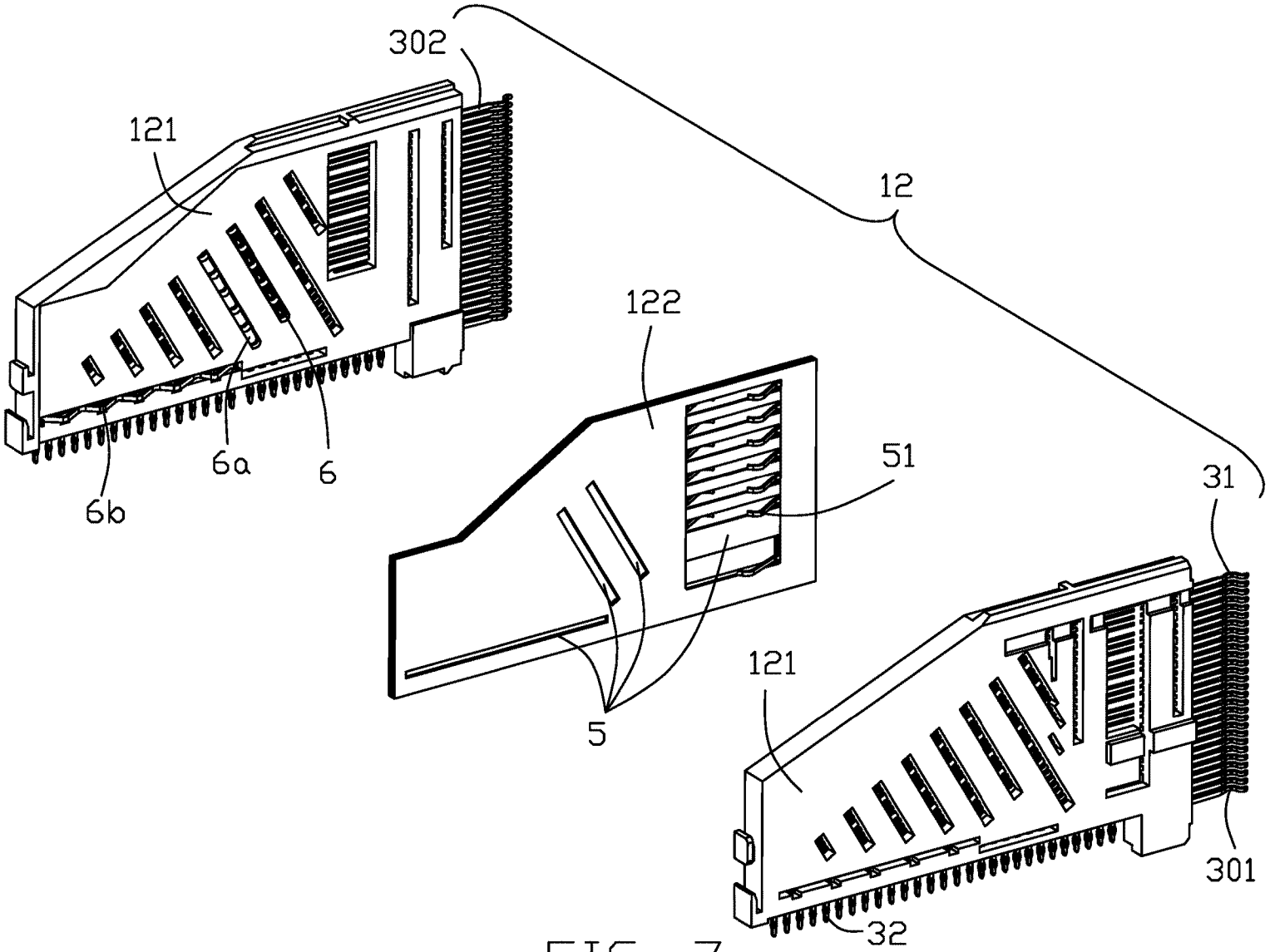
FIG. 7 is another explode perspective view of the connection module of the electrical connector of FIG. 6.
Figure 8:
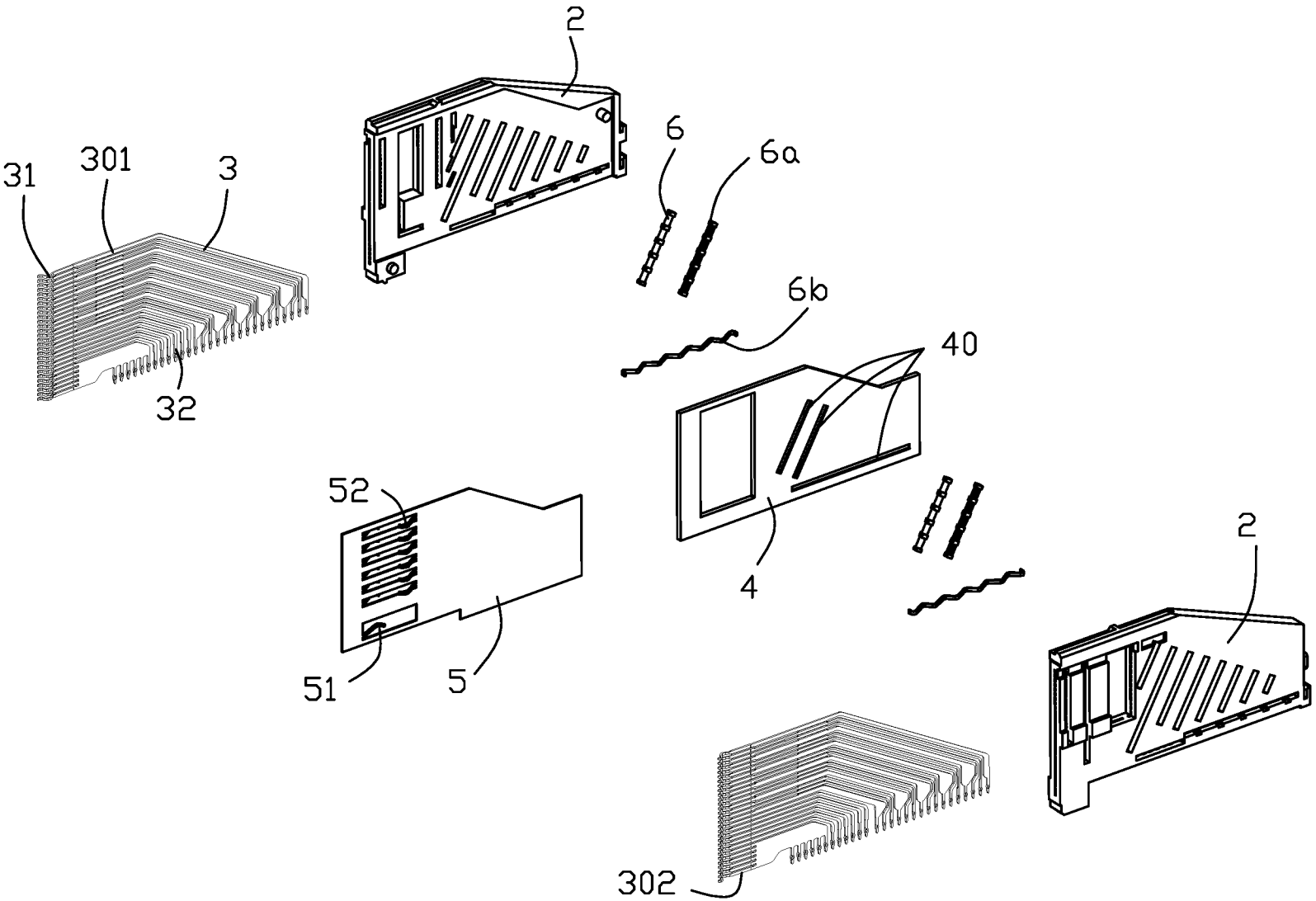
FIG. 8 is a further exploded perspective view of the connection module of the electrical connector of FIG. 6.
Figure 9:
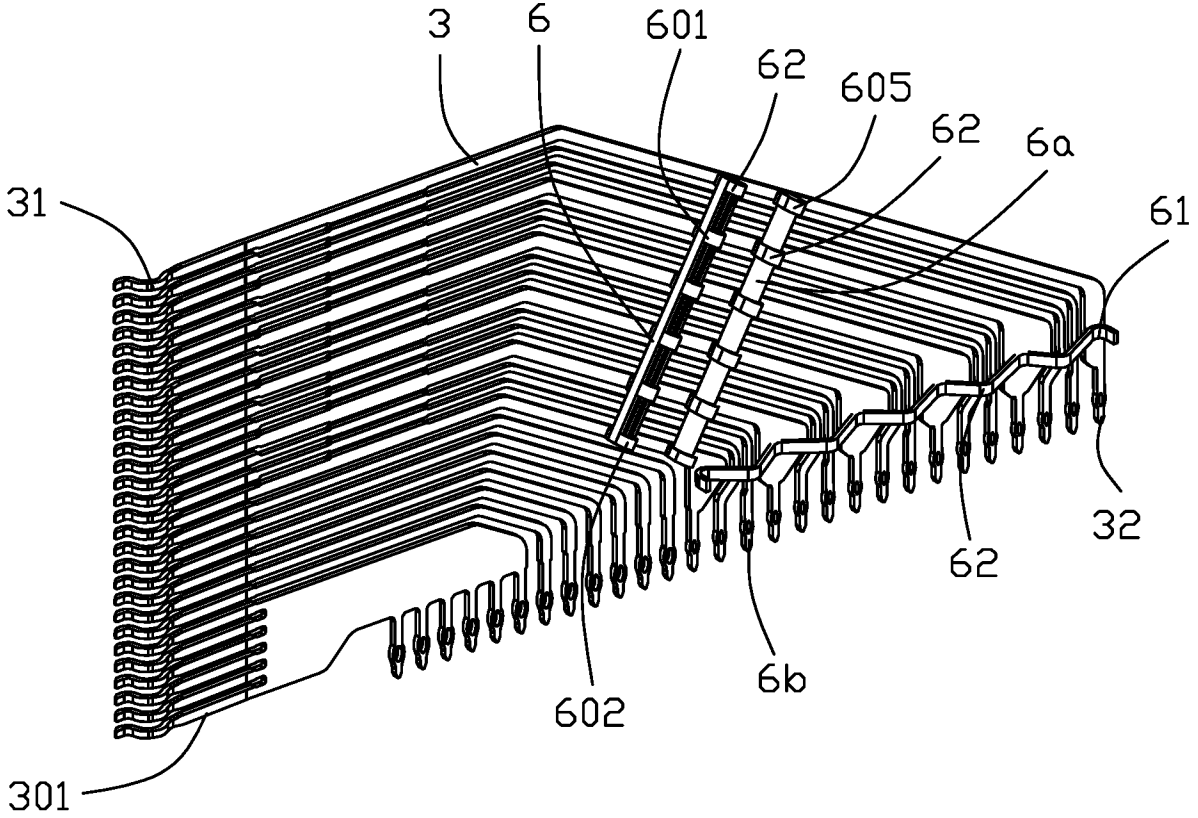
FIG. 9 is a perspective view showing the grounding bars mechanically and electrically connected to the grounding contacts of the first contacts.
Figure 10:
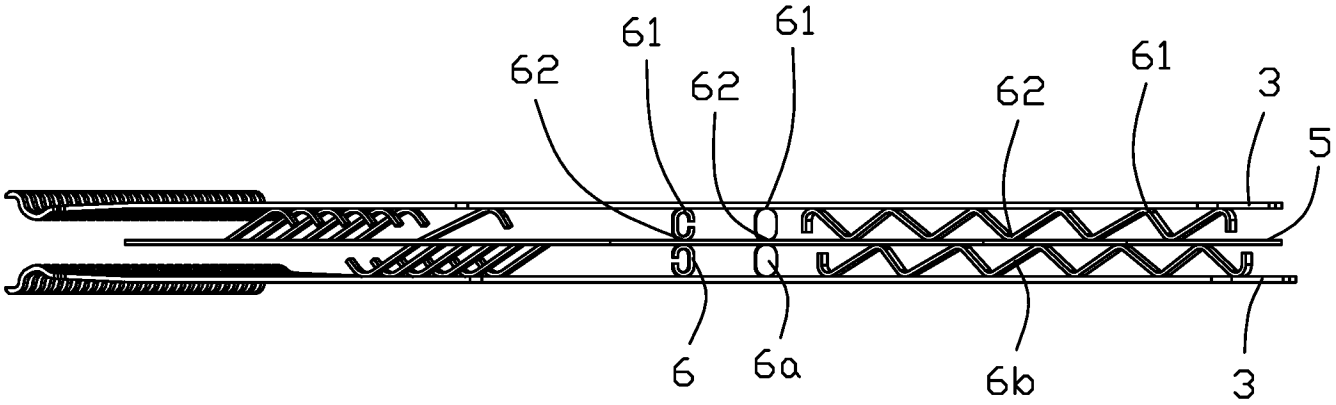
FIG. 10 is a top view of the connection module without the insulative wafers of FIG. 6.
Figure 11:
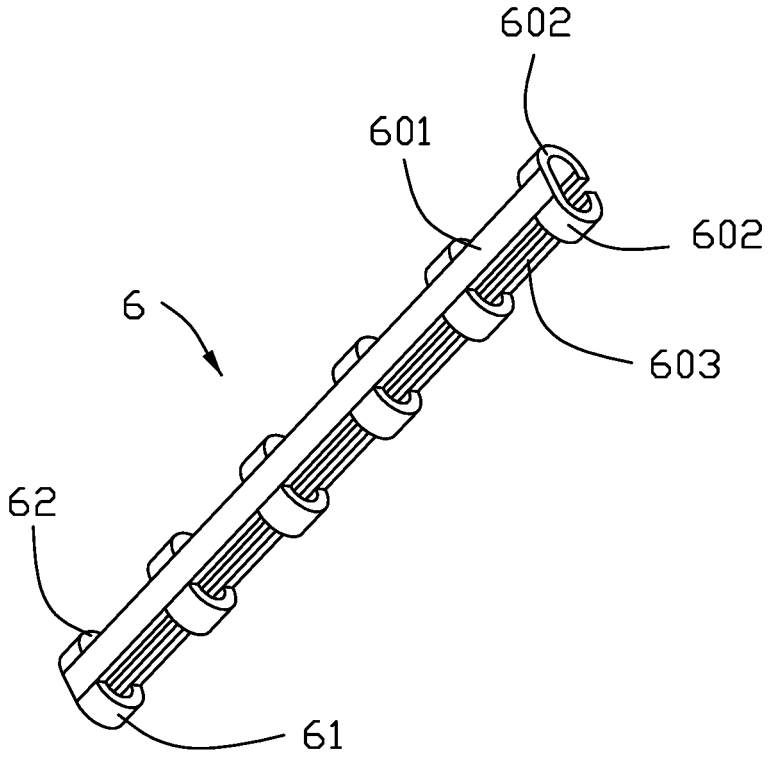
FIG. 11 is a perspective view of the first type grounding bar of the connection module of the electrical connector of FIG. 6.
Figure 12:
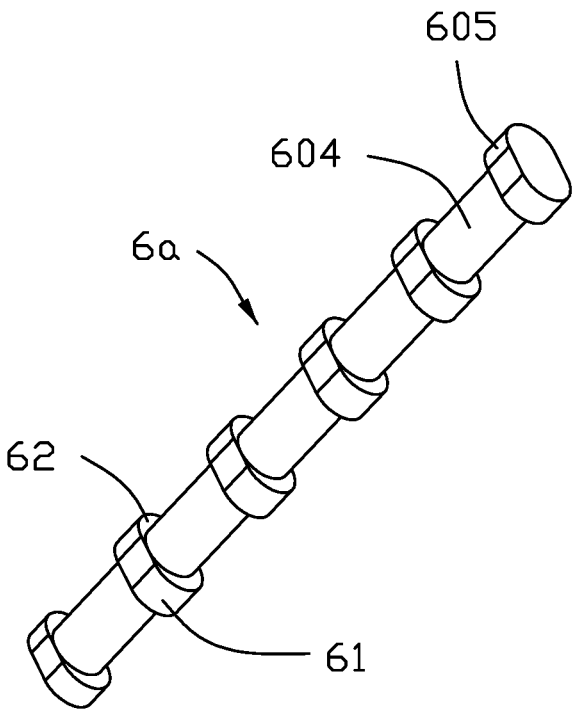
FIG. 12 is a perspective view of the second type grounding bar of the connection module of the electrical connector of FIG. 6.
Figure 13:
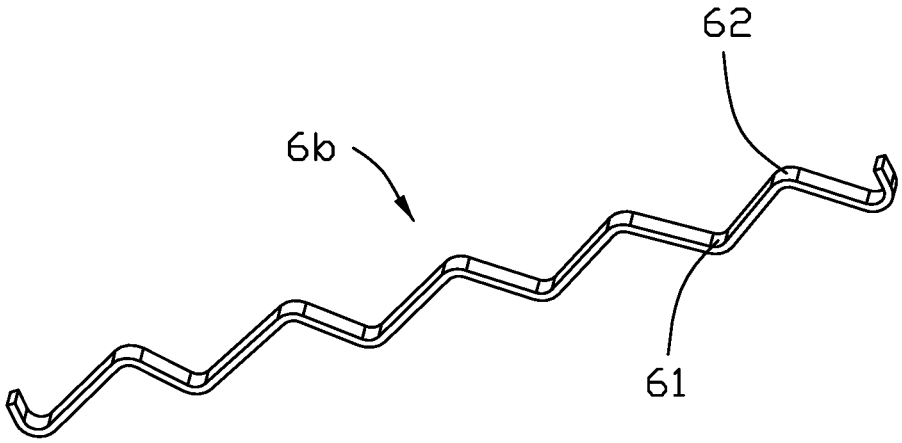
FIG. 13 is a perspective view of the third type grounding bar of the connection module of the electrical connector of FIG. 6.

Referring to FIGS. 1-13, an electrical connector 100 mounted upon a printed circuit board 200 for mating with a plug connector (not shown) with a board like mating tongue thereof. The connector 100 includes an insulative housing 11 with a receiving space 110 to receive the connection module 12 therein. A metallic shield 13 encloses the housing 11. The connection module 12 includes a pair of vertical contact modules 121 commonly sandwiching a vertical grounding module 122 therebetween in a horizontal direction. The pair of contact modules 121 are generally symmetrical with each other with regard to the grounding module 122. The contact module 121 includes an insulative (contact) wafer 2 and a plurality of contacts 301, 302 integrally formed therein via insert-molding. In detail, the contact modules 121 include a first contact module 121 with corresponding first contacts 301, and a second contact module 121 with corresponding second contacts 302. Each of the first contacts and the second contacts has a mating section 31 exposed in the receiving space 110, and a mounting section 32 exposed outside of the housing 11. The grounding module 122 includes a metallic grounding plate 5 embedded within an insulative (ground) wafer 4.

The first contacts 301 are arranged in line in a vertical plane and include at least two grounding contacts 3. The grounding plate 5 includes a plurality of first fingers 51 respectively mechanically and electrically connecting to the corresponding grounding contacts 3 of the first contacts 301. A plurality of grounding bars 6 are disposed between the grounding plate 5 and the grounding contacts 3 in the horizontal direction. The grounding bar 6 includes a plurality of inward/first parts 61 respectively mechanically and electrically connecting to the corresponding grounding contacts 3, and a plurality of outward/second parts 62 respectively mechanically and electrically connecting to the grounding plate 5. Notably, the grounding bars 6 are located in the region between the mating sections 31 and the mounting sections 32 of the contacts. The wafer 40 of the grounding module 122 forms the corresponding grooves 40 to receive at least the inward parts 61 of the corresponding grounding bars 6. Similarly, the wafer 2 forms the corresponding grooves (not labeled) to receive at least the outward part 62 of the corresponding grounding bars 6. Generally speaking, the groove of the wafer 2 essentially received the main portion of the corresponding grounding bar 6. Notably, in this embodiment, in a side view the grounding bar 6 extends in an oblique direction which is perpendicular to an extension direction of the contacts.

Similarly, the grounding plate 5 further includes a plurality of second fingers 52 to respectively mechanically and electrically connecting to the corresponding grounding contacts 3 of the second contacts 302. The grounding bars 6 are also disposed between the grounding plate 5 and the grounding contacts of the second contacts 302 and received within the grooves of the wafer 2 of the corresponding contact module 121 and the wafer 4 of the grounding module 122. In this embodiment, the grounding bar 6 cam be made of copper or the conductive plastic. Optimally, the conductive glue may be applied to the areas between the fingers 51, 52 and the corresponding grounding contacts 3, and those between the grounding bars 6 and the grounding plate 5 and those between the grounding bar 6 and the grounding contacts 3. Also, in the side view, the grounding bars 6 extend in the direction perpendicular to the extension direction of the second contacts 302 between the mating section 31 and the mounting section 32 of the second contacts 302.

The grounding bars 6 include a variety of configurations. The first type grounding bar 6*a* includes an elongated shaft 601 and a plurality of arc sections 602 with a C-shaped cross-section wherein the contacting points 61, 62 for contacting the grounding plate 5 and the grounding contact 3 are formed at apexes of the C-shaped cross-section. A plurality of linking bars 603 are linked between the free ends of the arc sections 602. The second type grounding bar 6*a* includes a solid column and a plurality of protrusions 605 wherein the contacting points 61, 62 are formed on the corresponding protrusions 605. The material of the grounding bar 6 can be copper or conductive plastic, and the conductive glue can be applied to the joined areas between the grounding bar and the grounding plate or those between the grounding bar and the grounding contacts. The third type grounding bar 6*b* is of a serpentine configuration with the contacting points 61, 62 at the corresponding apexes.

Figure 14:
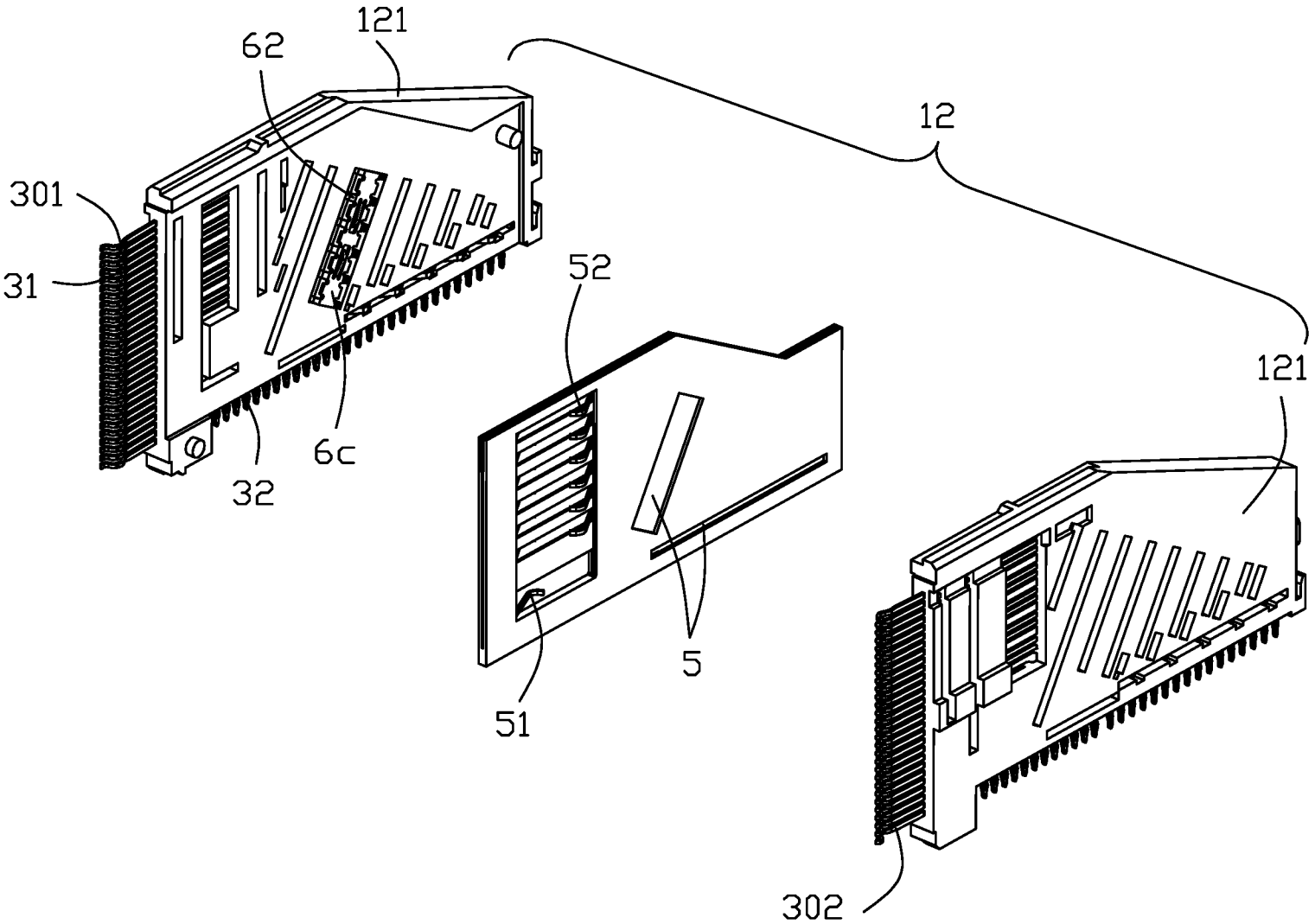
FIG. 14 is an exploded perspective view of the connection module of the electrical connector according to another embodiment of the invention.
Figure 15:
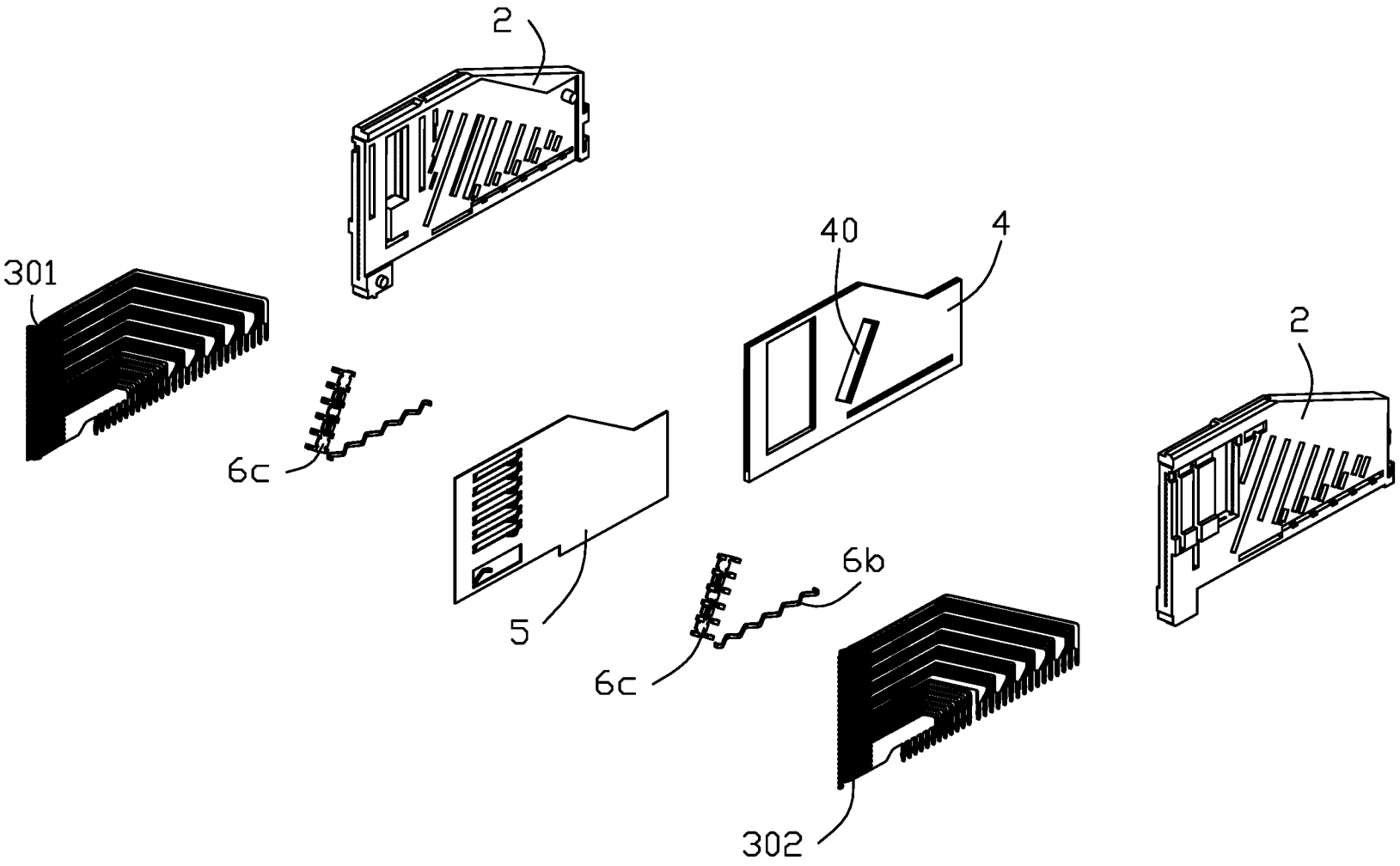
FIG. 15 is a further exploded perspective view of the connection module of the electrical connector of FIG. 14.
Figure 16:
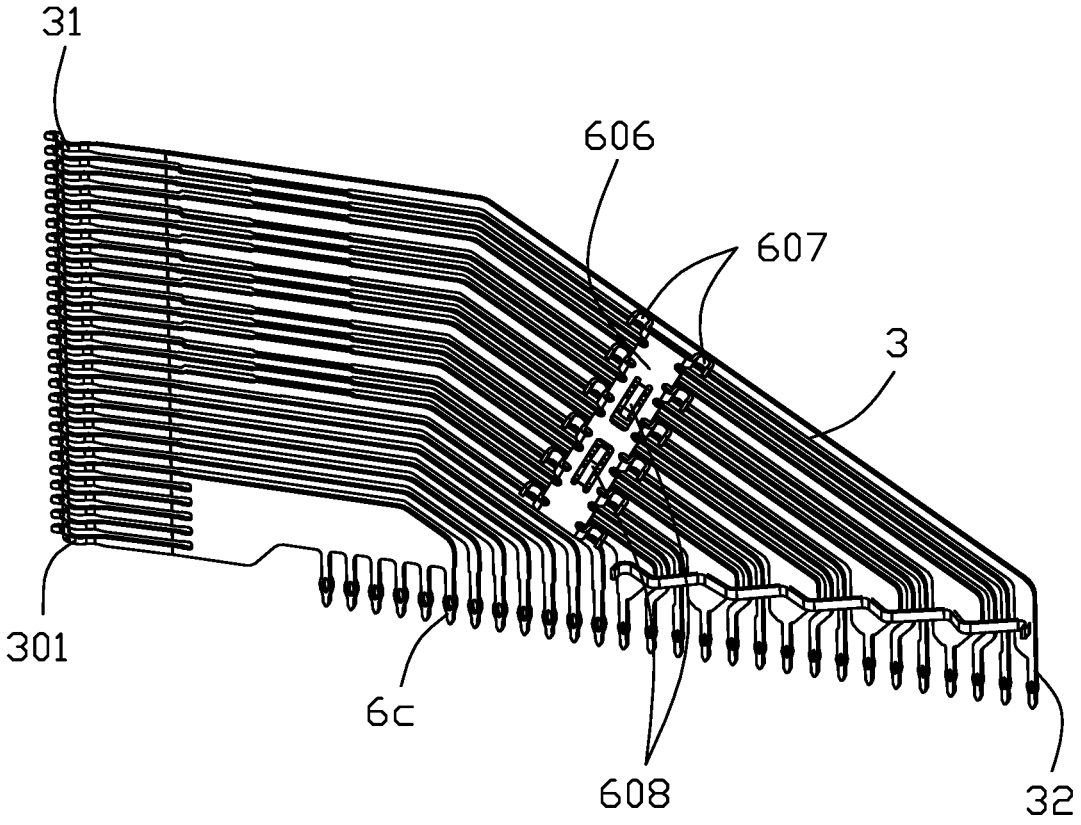
FIG. 16 is a perspective view of the grounding bar mechanically and electrically connecting to the grounding contacts of the first contact.
Figure 17:
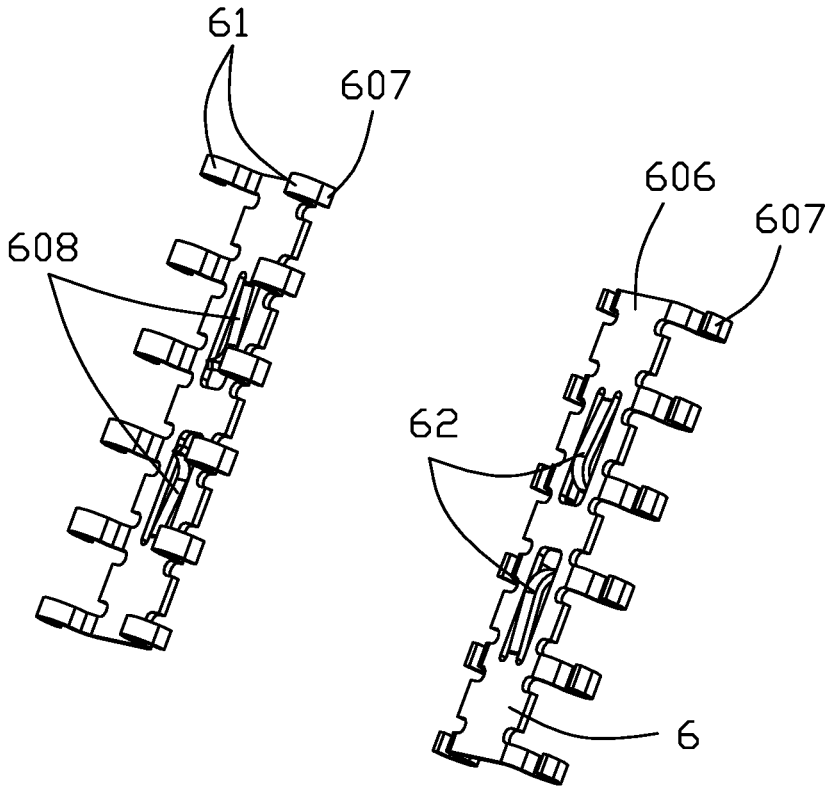
FIG. 17 is the perspective view of the grounding bars of the connection module of the electrical connector of FIG. 14.
Figure 18:
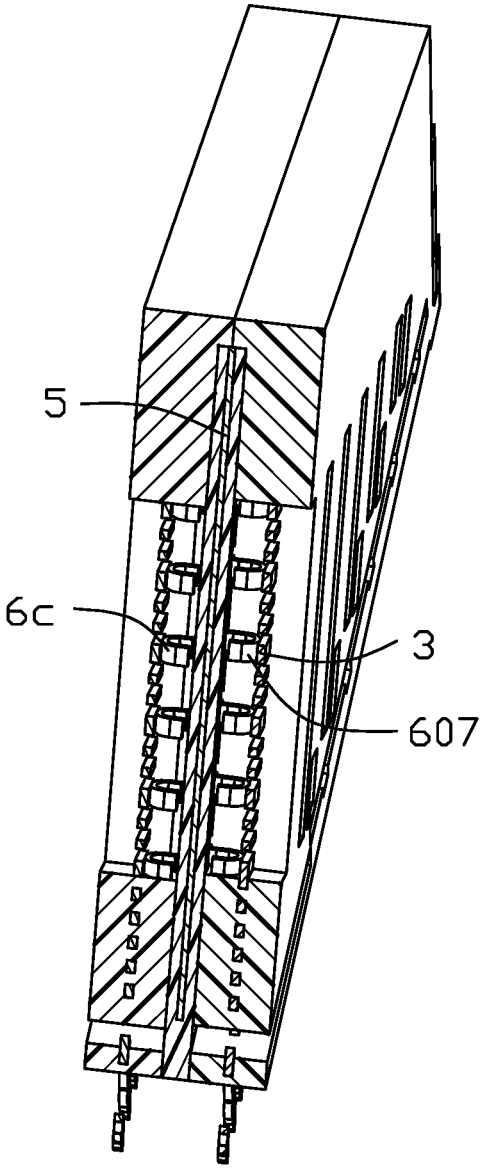
FIG. 18 is a cross-sectional view of the connection module of the electrical connector of FIG. 14.
Figure 19:
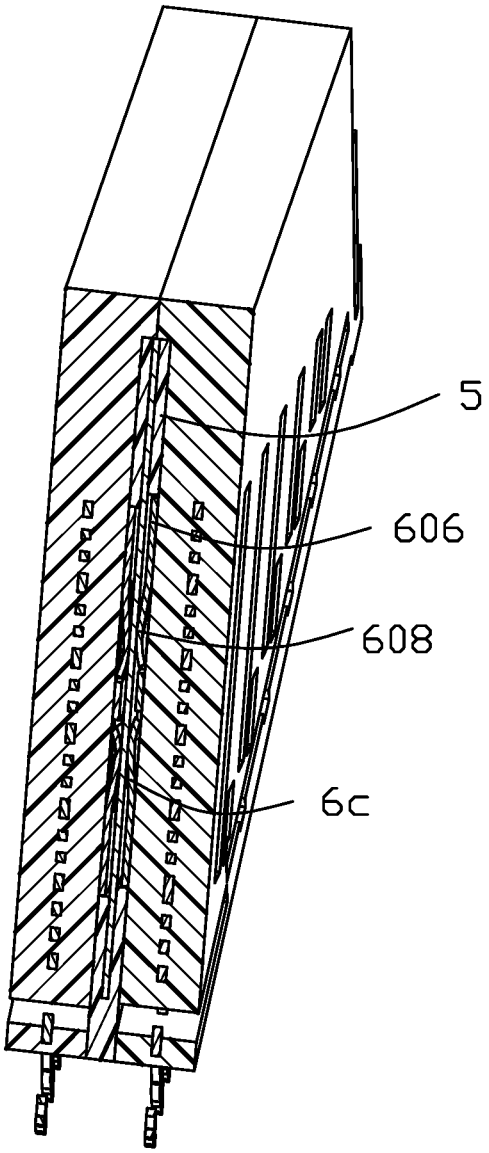
FIG. 19 is another cross-sectional view of the connection module of the electrical connector of FIG. 14.

Referring to FIGS. 14-19, the grounding bar 6*c* includes an elongated main body 606, a plurality of spring tabs 607 extending toward the grounding contacts 3 and forming the first contacting points 61 for contacting the grounding contacts 3, and a pair of spring tangs 608 extending toward the grounding plate 5 and forming the seconding points 62 for contacting the grounding plate 5.

Understandably, there are a plurality of grounding bars 6 between the grounding contacts 3 of each contact module 121 and the grounding plate 5 of the grounding module 122, and those grounding bars 6 can be different from one another for compliance with the positions as shown in the aforementioned embodiments. Therefore, there are multiple contacting points between each grounding contact and the grounding plate to significantly reduce the resonance effect. Notably, each contact has the connecting section between the mating section and the mounting section, and said connecting section is divided into three segments, i.e., a horizontal segment adjacent to the mating section, a vertical segment adjacent to the mounting section, and an oblique segment between the horizontal segment and the vertical segment. In a side view, the grounding bar extends in a first direction and the corresponding segment extends in a second direction perpendicular to the first direction.

In the invention, the connection module 12 forms ribs 120 to be received within the corresponding slots 111 *f* the housing 11 so as to guide insertion of the connection module 12 into the receiving space 110. A first fastener 14 is assembled to the housing 11, and the second fastener 15 is assembled to the shield 13. The first fastener 14 includes the first fastening piece 141 and the second fastening pieces 142. The shield 13 forms a fastening post 130. The second fastener 15 forms a hole 150 securing the post 130, and a third fastening piece 151. The housing 11 and the shield 13 are secured to each other via the first fastening piece 141 at the top and the third fastener 151 at the bottom. The connection module 12 is secured to the housing 11 by the second fastening pieces 142 engaged with the corresponding channels (not labeled) in the wafers 2 of the connection module 12.

Although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. An electrical connector comprising:

an insulative housing defining a receiving space;

a connection module received within the receiving space and including a pair of vertical contact modules commonly sandwiched a vertical grounding module therebetween in a horizontal lateral direction, each of said contact modules including a plurality of contacts embedded within an insulative contact wafer via an insert-molding, a plurality of first grooves formed in the insulative contact wafer the grounding module including a metallic grounding plate embedded within an insulative wafer via an insert-molding, a plurality of second grooves formed in the insulative ground wafer and aligned with the corresponding first grooves, respectively, in the horizontal lateral direction; and a plurality of grounding bars each received within one corresponding first groove and one corresponding second groove; wherein each grounding bar includes an inward part mechanically and electrically connecting to the grounding plate, and a plurality of outward parts mechanically and electrically connecting to corresponding grounding contacts of the contacts of one contact module.

2. The electrical connector as claimed in claim 1, wherein one of the grounding bars includes an elongated shaft, and a plurality of arc sections each having a C-shaped cross-section, and each arc section defines said inward part and said outward part opposite to each other.

3. The electrical connector as claimed in claim 1, wherein one of the grounding bars includes a solid column with thereon a plurality of protrusions each form said inward part and said outward part opposite to each other.

4. The electrical connector as claimed in claim 1, wherein one of the grounding bars forms a serpentine structure forming said inward parts and outward parts alternately.

5. The electrical connector as claimed in claim 1, wherein one of the grounding bars includes a main body with a plurality of spring tangs forming said outward parts, and a plurality of spring tabs forming said inward parts.

6. The electrical connector as claimed in claim 5, wherein each spring tang extends in a first direction while each spring tab extends in a second direction perpendicular to each other.

7. The electrical connector as claimed in claim 1, further including a metallic fastener secured to the housing and including a plurality of fastening pieces to be received within corresponding channels formed in an exterior surface of the contact wafers.

8. The electrical connector as claimed in claim 7, further including a metallic shield enclosing housing, wherein said shield and said housing are secured to each other by said fastener.

9. The electrical connector as claimed in claim 1, wherein each contact includes a mating section extending into the receiving space, a mounting section exposed outside of the housing, and a connecting section linked between the mating section and the mounting section, said connecting section includes a horizontal segment adjacent to the mating section, a vertical section adjacent to the mounting section, and an oblique segment linked between the horizontal segment and the vertical segment, and the grounding bars are positioned corresponding the connecting section and perpendicular to the corresponding segments in a side view along said horizontal lateral direction.

10. The electrical connector as claimed in claim 1, wherein the grounding plate includes a plurality of first spring fingers mechanically and electrically connecting to the grounding contacts of the contacts of one of the contact modules, and a plurality of second spring fingers mechanically and electrically connecting to the grounding contacts of the contacts of the other of the contact modules.

11. The electrical connector as claimed in claim 10, wherein the insulative ground wafer forms a groove through which the first spring tangs and the second spring tangs extend in the horizontal lateral direction.

12. The electrical connector as claimed in claim 10, wherein the first spring tangs extend in toward each other in a front-to-back direction while away from each other in the horizontal lateral direction.

13. An electrical connector comprising:

an insulative housing defining a receiving space;

a connection module received within the receiving space and including a pair of vertical contact modules commonly sandwiched a vertical grounding module therebetween in a horizontal lateral direction, each of said contact modules including a plurality of contacts embedded within an insulative contact wafer via an insert-molding, a plurality of grooves formed in the insulative contact wafer the grounding module including at least a metallic grounding plate; and a plurality of grounding bars each received within one corresponding groove;

wherein each grounding bar includes an inward part mechanically and electrically connecting to the grounding plate, and a plurality of outward parts mechanically and electrically connecting to corresponding grounding contacts of the contacts of one contact module.

14. The electrical connector as claimed in claim 13, wherein each contact includes a mating section extending into the receiving space, a mounting section exposed outside of the housing, and a connecting section linked between the mating section and the mounting section, said connecting section includes a horizontal segment adjacent to the mating section, a vertical section adjacent to the mounting section, and an oblique segment linked between the horizontal segment and the vertical segment, and the grounding bars are positioned corresponding the connecting section and perpendicular to the corresponding segments in a side view along said horizontal lateral direction.

15. The electrical connector as claimed in claim 14, wherein the grounding plate includes a plurality of first spring tangs extending toward one groove of one of the contact wafers to contact the grounding contacts of the contacts of said one of the contact wafers, and a plurality of second spring tangs extending toward one groove of the other of the contact wafers to contact the grounding contacts of the contacts of said other of the contact wafers, and the first spring tangs and the second spring tangs extend away from each other in the horizontal lateral direction.

16. The electrical connector as claimed in claim 15, wherein the first spring tangs and the second spring tangs extend toward each other in a front-to-back direction perpendicular to the horizontal lateral direction.

17. The electrical connector as claimed in claim 13, wherein a metallic fastener is secured upon the housing and including a plurality of fastening pieces to be engaged within corresponding channels formed in exterior surfaces of the connection module so as to secure the connection module to the housing.

18. An electrical connector comprising:

an insulative housing forming a receiving space;

a metallic shield enclosing the housing;

a connection module received within the receiving space and including a pair of vertical contact modules commonly sandwiched a vertical grounding module therebetween in a horizontal lateral direction, each of said contact modules including a plurality of contacts embedded within an insulative contact wafer via an insert-molding;

the grounding module including at least a metallic grounding plate, and grounding contacts of the contacts of both the contact modules electrically connected to the grounding plate via either a plurality of spring fingers unitarily extending from the grounding plate, or a plurality of grounding bars discrete from the grounding plate but located between the grounding plate the grounding contacts of the contacts of both the contact modules and mechanically and electrically connected therebetween; wherein a metallic fastener is secured to the housing and includes a plurality of fastening pieces to be received within corresponding channels in the contact wafers for securing the connection module to the housing.

19. The electrical connector as claimed in claim 18, wherein said fastener further includes another fastening piece to secure to the housing to the shield.

20. The electrical connector as claimed in claim 18, wherein the contact wafer forms a plurality of through grooves to receive either the grounding bars or the spring fingers.

* * * * *